US010046431B2

(12) United States Patent
Chen

(10) Patent No.: US 10,046,431 B2
(45) Date of Patent: Aug. 14, 2018

(54) DEBURRING MACHINE ABRASIVE BELT, CHAMFERING-DEBURRING MACHINE THAT DEBURRS TWICE PER ROTATION, AND DEBURRING METHOD

(76) Inventor: Yongqi Chen, Zhejiang (CN)

( * ) Notice: Subject to any disclaimer, the term of this patent is extended or adjusted under 35 U.S.C. 154(b) by 461 days.

(21) Appl. No.: 13/996,946

(22) PCT Filed: Jul. 12, 2012

(86) PCT No.: PCT/CN2012/078559

§ 371 (c)(1),
(2), (4) Date: Jun. 21, 2013

(87) PCT Pub. No.: WO2013/040938

PCT Pub. Date: Mar. 28, 2013

(65) Prior Publication Data

US 2013/0288579 A1 Oct. 31, 2013

(30) Foreign Application Priority Data

Sep. 21, 2011 (CN) ..... 2011 1 0281801

(51) Int. Cl.
*B24B 21/00* (2006.01)
*B24B 21/12* (2006.01)
(Continued)

(52) U.S. Cl.
CPC ..... *B24B 21/008* (2013.01); *B24B 9/002* (2013.01); *B24B 21/12* (2013.01);
(Continued)

(58) Field of Classification Search
CPC ..... B24B 21/008; B24B 21/12; B24B 21/04; B24B 21/06; B24D 11/00; B24D 11/06;
(Continued)

(56) References Cited

U.S. PATENT DOCUMENTS 2,294,245 A * 8/1942 Schlegel ..... A46B 3/04 15/226
4,140,456 A * 2/1979 Sato ..... C11D 13/28 425/371

(Continued)

FOREIGN PATENT DOCUMENTS

WO 2007/012438 A1 2/2007

*Primary Examiner* — Joseph J Hail
*Assistant Examiner* — Henry Hong

(57) ABSTRACT

The present invention relates to a one-circle two-chamfer deburring machine and a deburring method comprising the following steps after starting up: (1) The upper wheelhead motor drives the upper grinding belt to rotate horizontally (2) the lower wheelhead motor drives the lower grinding belt to rotate horizontally and (3) when a deburred workpiece goes through a passage formed by the active feeding roller row and the upper grinding belt, an upper abrasive block elastically contacts surface of the workpiece and, under the drive of the upper wheelhead motor and the upper active drum, polishes and deburrs the front side of the workpiece twice; the lower abrasive block elastically contacts the surface of the workpiece and, under the drive of the lower wheelhead motor and the lower active drum, polishes and deburrs the back side of the workpiece twice.

7 Claims, 4 Drawing Sheets

(51) Int. Cl.
*B24B 27/00* (2006.01)
*B24D 11/00* (2006.01)
*B24B 9/00* (2006.01)

(52) U.S. Cl.
CPC ..... *B24B 27/0069* (2013.01); *B24B 27/0076* (2013.01); *B24D 11/00* (2013.01)

(58) Field of Classification Search
CPC ..... B24D 7/06; B24D 13/10; B24D 13/04; B24D 13/045
USPC ..... 451/529, 302, 299, 513
See application file for complete search history.

(56) References Cited

U.S. PATENT DOCUMENTS 4,571,893 A * 2/1986 Braasch ..... B24D 99/00 451/298
4,646,475 A * 3/1987 Curtis ..... B24B 47/02 451/308
6,129,615 A * 10/2000 Corman ..... B24B 21/18 451/296
6,454,638 B2 * 9/2002 Bonachera ..... B24B 5/42 451/302
6,533,644 B1 * 3/2003 Horie ..... B24B 7/228 428/141
8,066,555 B2 * 11/2011 Bajaj ..... B24B 37/26 451/527
2004/0234346 A1 * 11/2004 Manigel ..... B24D 15/02 407/29.11
2008/0098659 A1 * 5/2008 Sung ..... B24D 18/0072 51/293
2008/0176494 A1 * 7/2008 Palushaj ..... B24B 7/186 451/353
2009/0104859 A1 * 4/2009 Weiland ..... B24B 21/04 451/296
2010/0041324 A1 * 2/2010 Shinoda ..... B24B 29/005 451/466
2011/0009037 A1 * 1/2011 Suzuki ..... B24D 13/10 451/285

* cited by examiner

DEBURRING MACHINE ABRASIVE BELT, CHAMFERING-DEBURRING MACHINE THAT DEBURRS TWICE PER ROTATION, AND DEBURRING METHOD

RELATED APPLICATION INFORMATION

This application is a 371 of International Application PCT/CN2012/078559 filed 12 Jul. 2012 entitled "Deburring Machine Abrasive Belt, Chamfering-Deburring Machine That Deburrs Twice Per Rotation, And Deburring Method", which was published on 28 Mar. 2013, with International Publication Number WO 2013/040938 A1, and which claims priority from Chinese Application No.: 201110281801.6 filed 21 Sep. 2011, the contents of which are incorporated herein by reference.

The present invention relates to a deburring-machine abrasive belt and a one-circle two-chamfer deburring machine and a deburring method where, on one hand, the matrix surface of the annular grinding belt is driven laterally and annularly, while the wheelhead located on the lateral annular belt surface deburrs up or down with a very high grinding efficiency, and on the other hand, with the annular grinding belt completing one revolution, the wheelhead located on the annular grinding belt (the abrasive block) can deburr and polish each surface of the workpiece forward and backward twice, and belongs to the field of manufacture of the deburring machine.

BACKGROUND TECHNOLOGIES

The annular grinding belt disclosed in the patent DE10320295A1 was designed in structure to be composed of an annular grinding base belt and multiple wheelheads fixed perpendicularly on the belt surface of the annular grinding base belt, the annular grinding belt being driven annularly up and down and driving the multiple wheelheads to be annularly driven.

The patent CN101262980B titled "A Device for Deburring or Grinding Ribbon or Sheet Metal Workpieces" disclosed that the device had at least one processing unit, which has a rotary drive device that guides the processed element through the region of the workpiece to be processed nearly straightly in the direction inclined or perpendicular to the feeding direction of the workpiece. According to the present invention, the processing unit is designed to be a grinding belt (4), which is thus functionally connected with the drive device (3) in the region of the workpiece (1) to be processed, making the drive device (3) drive the grinding belt (4); and the grinding belt (4) and the drive device (3) are separated from each other at least in the region (10) away from the workpiece (1).

The patent CN1732065A titled "Device and Method Used for Processing Workpiece" disclosed a device used for processing a ribbon or sheet metallic workpiece, especially a device used for removing the oxide layer of the cutting surface and/or cutting edge of the workpiece. The device is characterized in that it is provided with a transport device (2) in cyclic rotation and at least one brush (3), where the transport device (2) makes the at least one brush (3) pass nearly straightly by the workpiece (1) to be processed.

The above background technologies have the following shortcomings: With the wheelhead mounted on the front of the annular grinding belt, the machine wheelhead can only be arranged vertically, and the workpiece can only be ground once by one-way passing through, with a low grinding efficiency.

CONTENTS OF INVENTION

Purpose of design: In order to avoid the shortcomings in the background technologies, the present invention designs a deburring-machine abrasive belt and a one-circle two-chamfer deburring machine and a deburring method where, on one hand, the matrix surface of the annular grinding belt is driven laterally and annularly, while the wheelhead located on the lateral annular belt surface deburrs up or down with a very high grinding efficiency, and on the other hand, with the annular grinding belt completing one revolution, the wheelhead located on the annular grinding belt (the abrasive block) can deburr and polish each surface of the workpiece forward and backward twice.

Design solution: The following design solution is adopted in order to attain the above design purpose: 1. The design that the multiple wheelheads are connected horizontally at their sides with the belt surface of the annular base belt equidistantly or non-equidistantly is one of the technical features of the present invention. This is done for the following purposes: (1) The wheelhead can be arranged horizontally and transversely; when the workpiece passes vertically by the wheelhead once, the annular grinding belt can grind twice forward and backward, with the deburring efficiency improved exactly by 100%. (2) Because the wheelhead is mounted in parallel at its side with the base belt, the distance between the grinding belt and the workpiece can be adjusted expediently by adjusting the grinding belt up and down, thus applicable to deburring the workpieces of different thickness and convenient adjustment of the grinding pressure. 2. The design that the upper brush plate is sheathed on the pillar of the wheelhead gantry is the second of the technical features of the present invention. This is done for the following purposes: (1) Because the upper brushing plate is connected with the lifting mechanism, the lifting mechanism can expediently drive the upper brush plate up and down; while the upper grinding belt, mounted in the upper wheelhead assembly of the upper brush plate and sheathed on the upper active drum and upper passive drum, under the drive of the upper wheelhead motor, can not only drive the upper grinding belt to rotate horizontally to make the multiple abrasive blocks fixed on the grinding belt polish and deburr the burr on the surface of the workpiece in the process of horizontal toroidal rotation, but also adapt to deburring the surface of the workpieces of different thickness through adjustment of the lifting mechanism. (2) Because the press plate in the upper grinding belt press pulley block is connected with the upper grinding belt lifting mechanism, which is connected with the upper brush plate and drives the upper grinding belt press pulley block to be able to depress and work in motion, the upper brush plate, after being positioned according to the thickness of the workpiece, through adjustment of lifting of the upper grinding belt lifting mechanism, can expediently make the upper grinding belt press pulley block press on the grinding belt to force the grinding belt elastically contact the deburred surface of the workpiece, thus attaining the purpose of deburring. (3) Because the upper grinding belt sheathed on the upper active drum and upper passive drum rotates horizontally and toroidally, the annular upper grinding belt can grind twice forward and backward when the workpiece passes vertically by the wheelhead once, with the deburring efficiency improved exactly by 100%, thus having a high efficiency. 3. The design that the lower brush plate is located below the bench is the third of the technical features of the present invention. This is done for the following purposes: (1) Because the lower active drum and the lower passive drum are mounted above the lower brush plate and the lower active drum is driven by the lower wheelhead motor located on the lower brush plate, the abrasive block sheathed on the lower grinding belt of the lower active drum and lower passive drum, when polishing in horizontal rotation the back of the workpiece, through adjustment of the lower grinding belt lifting mechanism, forces the lower grinding belt press pulley block matching with the end face of the lower grinding belt to jack upward in motion, making the abrasive block on the lower grinding belt elastically contact the back of the workpiece, thus attaining the purpose of deburring. (2) Because the lower grinding belt sheathed on the lower active drum and lower passive drum rotates horizontally and toroidally, the annular lower grinding belt can grind twice forward and backward when the workpiece passes vertically by the lower wheelhead once, with the deburring efficiency improved exactly by 100%, thus having a high efficiency, even more being able to achieve the effect of blind-angle deburring which cannot be achieved by the one-way multiple-time deburring. 4. The design that the surfaces of the active drum and passive drum are designed to be of a conical drum body is the fourth of the technical features of the present invention. This is done for the following purposes: Because the surface of the guide pulley is conical, the grinding belt sheathed on the two drums, when in the process of high speed rotation, can be controlled effectively in lifting, positioning, etc.; for ensuring elastic contact of the surface of the abrasive block in the grinding belt with the workpiece, the grinding belt press pulley block is used to depress or jack; when the abrasive belt is needed to leave the work position, the grinding belt press pulley block is separated from the end face of the grinding belt, and the grinding belt automatically ascends or descends to leave the work position. 5. The design of the grinding belt press pulley block is the fifth of the technical features of the present invention. This is done for the following purposes: The grinding belt press pulley block is composed of the press plate and the guide pulley; the press plate, in the structural design, has an equidistant or non-equidistant convex-concave structure at one of its sides, and has a boss portion provided with the guide pulley; with the surface of the press pulley on the same horizontal plane, when the lifting mechanism drives the press plate to move upward or downward, the press plate drives the multiple guide pulleys located thereon to act synchronously on the upper end face of the grinding belt, forcing the grinding belt to act synchronously, thus attaining the purpose of depressing or jacking the grinding belt. 6. The design that the guide pulley has an inner ring and an outer ring having a greater diameter than the inner ring is the sixth of the technical features of the present invention. This is done for the following purposes: Because the guide pulley has an inner ring and an outer ring having a greater diameter than the inner ring, the outer ring of the guide pulley, when the guide pulley acts on the grinding belt, can effectively play the role of position limiting and prevent the grinding belt from deviating from the surface of the guide pulley, so as to ensure the high consistency of dynamic movement of the grinding belt in motion.

The technical solution 1: A wheelhead-replaceable deburring-machine abrasive belt is provided, comprising an annular base belt, multiple wheelhead units being connected at their sides with belt surface of the annular base belt equidistantly or non-equidistantly.

The technical solution 2: A one-circle two-chamfer deburring machine composed of the wheelhead-replaceable deburring-machine abrasive belt is provided, a frame in the chamfer deburring machine being fixedly connected with a bench by four props; a wheelhead gantry, going through the bench, is fixedly connected at its lower end with the frame; an upper brush plate is sheathed on a pillar of the wheelhead gantry, and lifted along the pillar under the drive of a lifting mechanism driven by a motor located on the wheelhead gantry; an upper active drum and an upper passive drum are mounted on the upper brush plate, the upper active drum being driven by an upper wheelhead motor located on the upper brush plate; an upper grinding belt is horizontally sheathed on a driving wheel composed of the upper active drum and the upper passive drum, and located at one side of the wheelhead gantry; an upper grinding belt press pulley block is connected with an upper grinding belt lifting mechanism, which drives the upper grinding belt press pulley block to depress an end face of the upper grinding belt, the upper grinding belt lifting mechanism being driven by the upper grinding belt motor; a lower brush plate is located below the bench; a lower active drum and a lower passive drum are mounted on the lower brush plate, the lower active drum being driven by a lower wheelhead motor located on the lower brush plate; a lower grinding belt is horizontally sheathed on a driving wheel composed of the lower active drum and the lower passive drum, and located at the other side of the wheelhead gantry; a lower grinding belt press pulley block is connected with a lower grinding belt lifting mechanism, which drives the lower grinding belt press pulley block to jack up against an end face of the lower grinding belt, the lower grinding belt lifting mechanism being driven by the lower grinding belt motor.

The technical solution 3: A method of deburring with the one-circle two-chamfer deburring machine composed of the wheelhead-replaceable deburring-machine abrasive belt is provided, comprising the following steps after starting up: (1) The upper wheelhead motor drives the upper grinding belt to rotate horizontally by driving the upper active drum to rotate; (2) the lower wheelhead motor drives the lower grinding belt to rotate horizontally by driving the lower active drum to rotate; and (3) when a deburred workpiece goes through a passage formed by the active feeding roller row and the upper grinding belt, each time the upper grinding belt completes one revolution, an upper abrasive block fixed on the upper grinding belt, under the action of the upper grinding belt press pulley block, elastically contacts surface of the workpiece and, under the drive of the upper wheelhead motor and the upper active drum, polishes and deburrs the front side of the workpiece forward and backward twice; here each time the lower grinding belt located below the workpiece completes one revolution under the drive of the lower wheelhead motor and the lower active drum, the lower abrasive block elastically contacts the surface of the workpiece under the jacking action of the lower grinding belt press pulley block on the abrasive block located on the lower grinding belt and, under the drive of the lower wheelhead motor and the lower active drum, polishes and deburrs the back side of the workpiece forward and backward twice.

The present invention has the following features compared to the background technologies: (1) Because the upper wheelhead can be adjusted as a whole along the gantry-type guide pillar up and down, the adjustment range of the grinding distance can be up to above 180 mm, applicable to grinding and deburring workpieces of different thickness and having good applicability, while the comparative background technology only has a range of about 30 mm; (2) with the grinding belt being driven once, grinding is completed forward and backward twice, eliminating the defect of the background technology that a blind angle is left after multiple-time one-way deburring, having the characteristics of high efficiency and good quality of grinding, deburring and polishing; (3) the wheelhead, after being worn away, can be replaced without making the base belt discarded, not only saving the manufacturing cost but also avoiding waste of the raw materials; (4) the front and back sides of the workpiece can be polished and deburred, with the efficiency improved by 100% compared to the background technology; (5) not only the wheelhead on the grinding belt can polish and deburr in horizontal rotation, but also the wheelhead polishes and deburrs the workpiece twice when the grinding belt completes one revolution, with the deburring efficiency improved exactly by 100%; (6) it is expedient to polish and deburr the surface of workpieces of different thickness; (7) the abrasive block and the workpiece can elastically contact each other and be separated from each other automatically, with simple operation and high reliability.

BRIEF DESCRIPTIONS OF THE DRAWINGS

SPECIFIC METHOD OF USE

Example 1

Figure 1:
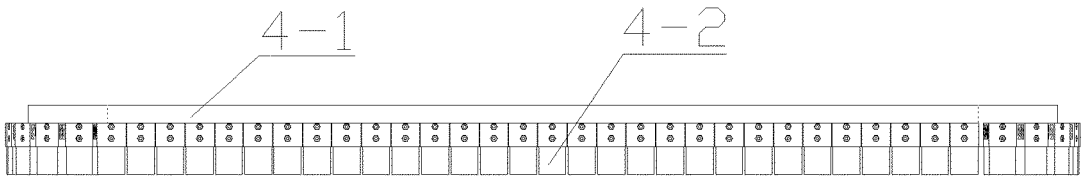
FIG. 1 is a structural schematic view of the wheelhead-replaceable deburring-machine abrasive belt.
Figure 2:
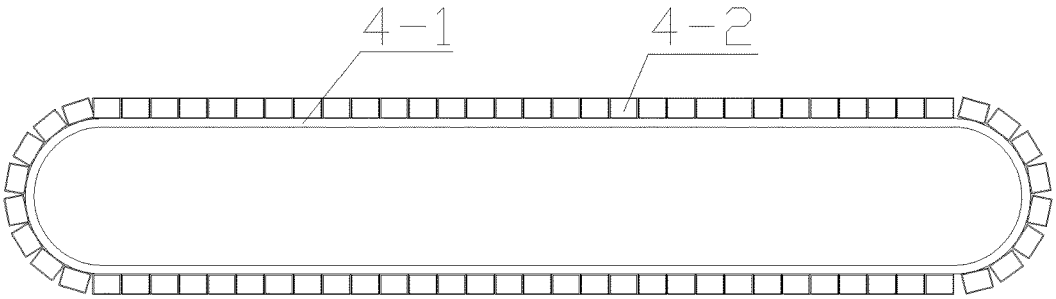
FIG. 2 is a structural schematic top view of the wheelhead-replaceable deburring-machine abrasive belt after being mounted.
Figure 3:
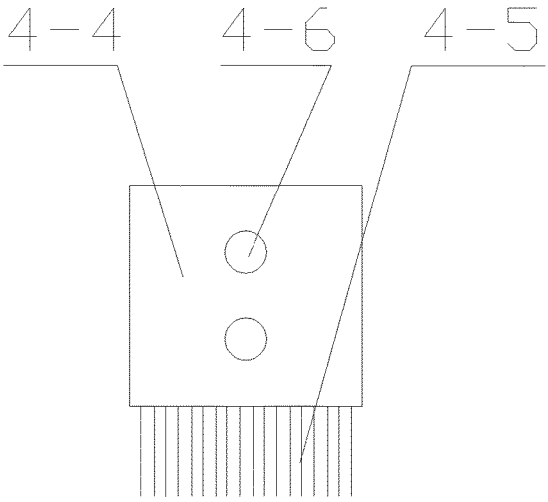
FIG. 3 is a structural schematic view of the wheelhead.
Figure 4:
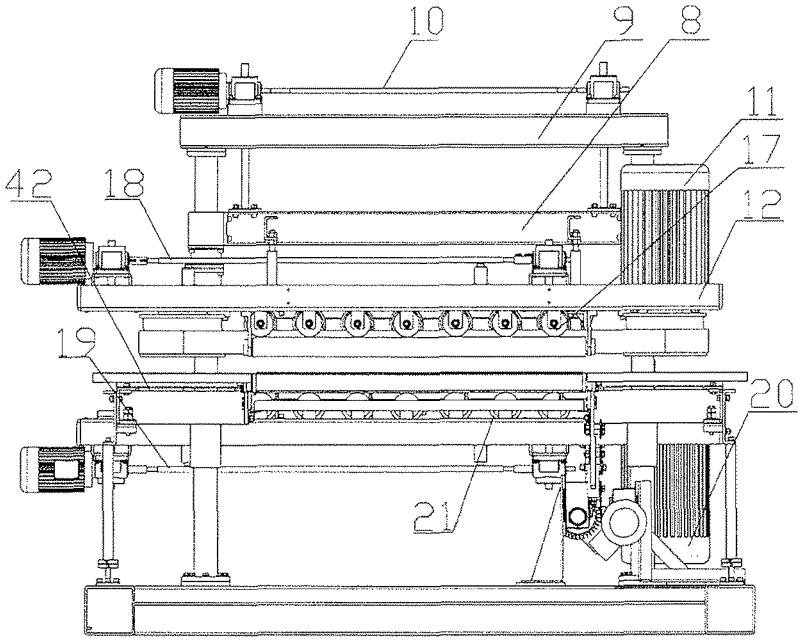
FIG. 4 is a structural schematic front view of the one-circle two-chamfer deburring machine.
Figure 5:
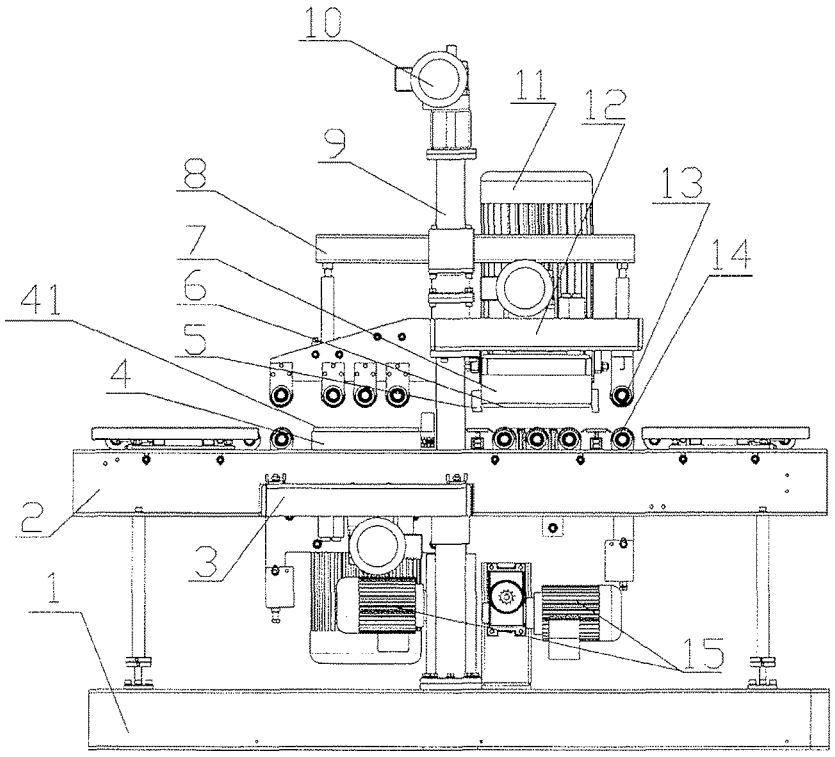
FIG. 5 is a structural schematic side view of FIG. 1.
Figure 6:
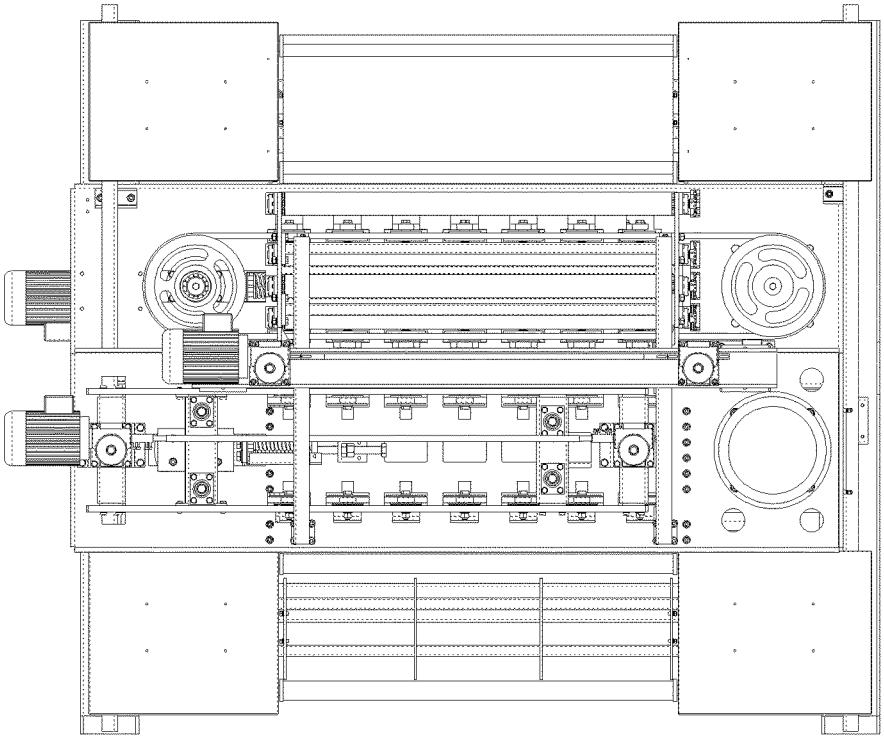
FIG. 6 is a structural schematic top view of FIG. 1.
Figure 7:
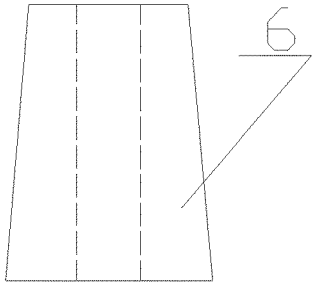
FIG. 7 is a structural schematic view of the drum.
Figure 8:
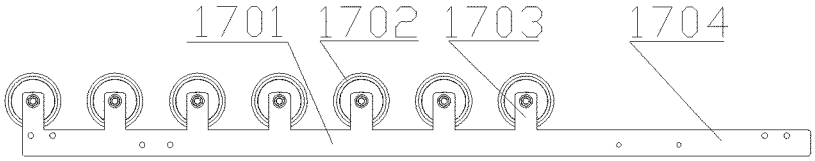
FIG. 8 is a structural schematic view of the grinding belt press pulley block.
Figure 9:
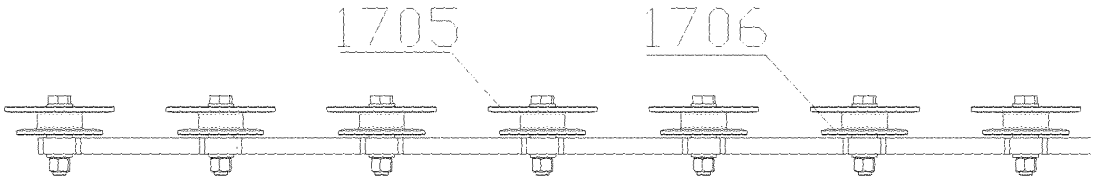
FIG. 9 is a structural schematic top view of FIG. 8.
Figure 10:
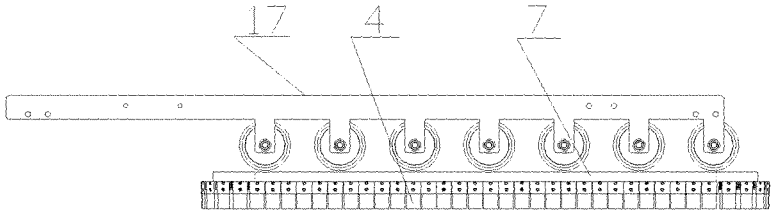
FIG. 10 is a structural schematic view of matching of the grinding belt press pulley block with the grinding belt.

With reference to FIGS. 1-3, a wheelhead-replaceable deburring-machine abrasive belt is provided, comprising an annular base belt 4-1, multiple wheelhead units 4-2 being connected at their sides with the belt surface of the annular base belt 1 equidistantly or non-equidistantly.

The wheelhead head 4-2 is composed of a wheelhead fixed body 4-4 and an abrasive 4-5 fixedly planted on the wheelhead fixed body 4-4. The side of the wheelhead 4-2 refers to the side of the wheelhead fixed body 4-4 in the wheelhead 4-2. The deburring wheelhead 4-5 is a metallic abrasive wire wheelhead or nonmetallic abrasive wheelhead. The metallic wire wheelhead refers to a wheelhead composed of multiple steel wires or copper wires; or the nonmetallic wheelhead refers to a wheelhead composed of multiple sheets of sand strip or multiple layers of sand belt or abrasive wires.

Example 2

With reference to FIGS. 4-10, a one-circle two-chamfer deburring machine is provided, comprising a chamfer deburring machine, a frame 1 in the chamfer deburring machine being fixedly connected with a bench 2 by four props; a wheelhead gantry 9, going through the bench 2, is fixedly connected at its lower end with the frame 1; an upper brush plate 12 is sheathed on a pillar of the wheelhead gantry 9, and lifted along the pillar under the drive of a lifting mechanism 8 driven by a motor 10 located on the wheelhead gantry 9; an upper active drum 6 and an upper passive drum 6 are mounted on the upper brush plate 12, the upper active drum 6 being driven by an upper wheelhead motor 11 located on the upper brush plate 12; an upper grinding belt 7 is horizontally sheathed on a driving wheel composed of the upper active drum 6 and the upper passive drum 6, and located at one side of the wheelhead gantry 9; an upper grinding belt press pulley block 17 is connected with an upper grinding belt lifting mechanism 18, which drives the upper grinding belt press pulley block 17 to depress an end face of the upper grinding belt 7; the multiple abrasive blocks 5 are mounted on the side of the grinding belt 7, the upper grinding belt lifting mechanism 18 being driven by the upper grinding belt motor; a lower brush plate 3 is located below the bench 2; a lower active drum 41 and a lower passive drum 42 are mounted on the lower brush plate 3, the lower active drum being driven by a lower wheelhead motor 20 located on the lower brush plate 3; a lower grinding belt 4 is horizontally sheathed on a driving wheel composed of the lower active drum 41 and the lower passive drum 42, and located at the other side of the wheelhead gantry 9; a lower grinding belt press pulley block 21 is connected with a lower grinding belt lifting mechanism 19, which drives the lower grinding belt press pulley block 21 to jack up against an end face of the lower grinding belt 4, the lower grinding belt lifting mechanism 19 being driven by the lower grinding belt motor. The upper active drum and the lower active drum have the same structure, the upper active drum having a taper slope section narrow at the top and wide at the bottom, the lower active drum having a taper slope section narrow contrary to that of the upper active drum. The upper grinding belt press pulley block 17 is fitted in the way of rolling depression with the end face of the upper grinding belt 7; and the lower grinding belt press pulley block 21 is fitted in the way of rolling jacking with the end face of the lower grinding belt 4. The upper grinding belt press pulley block, having the same structure with the lower grinding belt press pulley block, is composed of a press plate 1701 and a guide pulley 1702; the press plate 2 has a main portion of an equidistant or non-equidistant convex-concave structure 1703 and a non-main portion of a mounting handle 1704, and has a boss portion provided with a guide pulley 1702. The guide pulley 1702 has an inner ring and an outer ring having a greater diameter than the inner ring. The bench 2 is provided with an active feeding roller row 14, which is driven by a feeding motor 15 through a drive mechanism. The lifting mechanism 8 is a worm-worm gear lifting mechanism.

Example 2

On the basis of Example 2, a method of deburring with the one-circle two-chamfer deburring machine composed of the wheelhead-replaceable deburring-machine abrasive belt is provided, comprising the following steps after starting up: (1) The upper wheelhead motor 11 drives the upper grinding belt 7 to rotate horizontally by driving the upper active drum to rotate; (2) the lower wheelhead motor 20 drives the lower grinding belt 4 to rotate horizontally by driving the lower active drum to rotate; and (3) when a deburred workpiece goes through a passage formed by the active feeding roller row 14 and the upper grinding belt 7, each time the upper grinding belt 7 completes one revolution, an upper abrasive block 5 fixed on the upper grinding belt 7, under the action of the upper grinding belt press pulley block 17, elastically contacts the surface of the workpiece and, under the drive of the upper wheelhead motor 11 and the upper active drum, polishes and deburrs the front side of the workpiece forward and backward twice; here each time the lower grinding belt 7 located below the workpiece completes one revolution under the drive of the lower wheelhead motor 20 and the lower active drum, the lower abrasive block elastically contacts the surface of the workpiece under the jacking action of the lower grinding belt press pulley block 21 on the abrasive block located on the lower grinding belt 4 and, under the drive of the lower wheelhead motor 20 and the lower active drum, polishes and deburrs the back side of the workpiece twice.

What needs to be comprehended is as follows: Although the above examples made a more detailed text description of the design concept of the present invention, the text description is just a simple text description of the design concept of the present invention, rather than restriction of the design concept of the present invention; any combination, addition or modification not beyond the design concept of the present invention all falls within the scope of protection of the present invention.

What is claimed is:

1. A one-circle two-chamfer deburring machine comprising a wheelhead-replaceable deburring-machine abrasive belt, said belt comprising an annular base belt, wherein multiple wheelhead units are connected at their sides with a belt surface of the annular base belt equidistantly or non-equidistantly, said machine comprising a frame in the chamfer deburring machine is fixedly connected with a bench by four props; a wheelhead gantry, going through the bench, fixedly connected at its lower end with the frame; an upper brush plate sheathed on a pillar of the wheelhead gantry, and lifted along the pillar under the drive of a lifting mechanism driven by a motor located on the wheelhead gantry; an upper active drum and an upper passive drum mounted on the upper brush plate, the upper active drum being driven by an upper wheelhead motor located on the upper brush plate; an upper grinding belt is horizontally sheathed on an upper driving wheel composed of the upper active drum and the upper passive drum, and located at one side of the wheelhead gantry; an upper grinding belt press pulley block connected with an upper grinding belt lifting mechanism, which drives the upper grinding belt press pulley block to depress an end face of the upper grinding belt, the upper grinding belt lifting mechanism being driven by an upper grinding belt motor; a lower brush plate is located below the bench; a lower active drum and a lower passive drum are mounted on the lower brush plate, the lower active drum being driven by a lower wheelhead motor located on the lower brush plate; a lower grinding belt is horizontally sheathed on a lower driving wheel composed of the lower active drum and the lower passive drum, and located at the other side of the wheelhead gantry; a lower grinding belt press pulley block is connected with a lower grinding belt lifting mechanism, which drives the lower grinding belt press pulley block to jack up against an end face of the lower grinding belt, the lower grinding belt lifting mechanism being driven by a lower grinding belt motor.

2. The one-circle two-chamfer deburring machine composed of the wheelhead-replaceable deburring-machine abrasive belt according to claim 1, characterized in that: the upper active drum and the lower active drum have the same structure, the upper active drum having a taper slope section narrow at the top and wide at the bottom, the lower active drum having a taper slope section narrow contrary to that of the upper active drum.

3. The one-circle two-chamfer deburring machine composed of the wheelhead-replaceable deburring-machine abrasive belt according to claim 1, characterized in that: the upper grinding belt press pulley block is fitted in the way of rolling depression with the end face of the upper grinding belt; and the lower grinding belt press pulley block is fitted in the way of rolling jacking with the end face of the lower grinding belt.

4. The one-circle two-chamfer deburring machine composed of the wheelhead-replaceable deburring-machine abrasive belt according to claim 1, characterized in that: the upper grinding belt press pulley block, having the same structure with the lower grinding belt press pulley block, is composed of a press plate and a guide pulley; the press plate, having an equidistant or non-equidistant convex-concave structure, has a boss portion provided with a guide pulley.

5. The one-circle two-chamfer deburring machine composed of the wheelhead-replaceable deburring-machine abrasive belt according to claim 4, characterized in that: the guide pulley has an inner ring and an outer ring having a greater diameter than the inner ring.

6. The one-circle two-chamfer deburring machine composed of the wheelhead-replaceable deburring-machine abrasive belt according to claim 1, characterized in that: the bench is provided with an active feeding roller row, which is driven by a feeding motor through a drive mechanism.

7. The one-circle two-chamfer deburring machine composed of the wheelhead-replaceable deburring-machine abrasive belt according to claim 1, characterized in that: the lifting mechanism is a worm-worm gear lifting mechanism.

* * * * *